United States Patent [19]

Riva

[11] Patent Number: 4,687,149

[45] Date of Patent: Aug. 18, 1987

[54] DELIVERY DEVICE FOR CONTINUOUS THREADS

[75] Inventor: Ermete Riva, I-Pagnana di Merate, Italy

[73] Assignee: Sobrevin Société de brevets industriels-Etablissement, Vaduz, Liechtenstein

[21] Appl. No.: 829,663

[22] Filed: Feb. 14, 1986

[30] Foreign Application Priority Data

Feb. 23, 1985 [DE] Fed. Rep. of Germany ..... 3506490

[51] Int. Cl.[4] ..... B65H 51/20

[52] U.S. Cl. ..... 242/47.01; 242/47.12

[58] Field of Search ..... 242/47.01, 47.02, 47.03, 242/47.04, 47.05, 47.06, 47.07, 47.08, 47.09, 47.1, 47.11, 47.12, 47.13, 47, 49; 66/132 R, 132 T; 139/452

[56] References Cited

U.S. PATENT DOCUMENTS 4,298,172 11/1981 Hellstrom ..... 242/47.01

4,452,402 6/1984 Ghiardo ..... 242/47.01

*Primary Examiner*—Stanley N. Gilreath

*Attorney, Agent, or Firm*—Martin A. Farber

[57] ABSTRACT

A delivery device for continuous threads having a storage member to which the thread is fed in circumferential direction and from which it is withdrawn over its end and on which a given adjustable number of thread turns is stored as a withdrawal point, a light monitor which scans the circumferential surface of the storage member and controls the rotary drive for the feeding of the thread being provided in order to determine the number of thread turns. In order to make the thread tension uniform upon applying the thread to the storage member and in order to reduce the stresses acting on the braking device, the speed of rotation of the rotary drive is controlled as a function of the light intensity (amount of light) measured on the light monitor receiver.

8 Claims, 8 Drawing Figures

FIG. 1
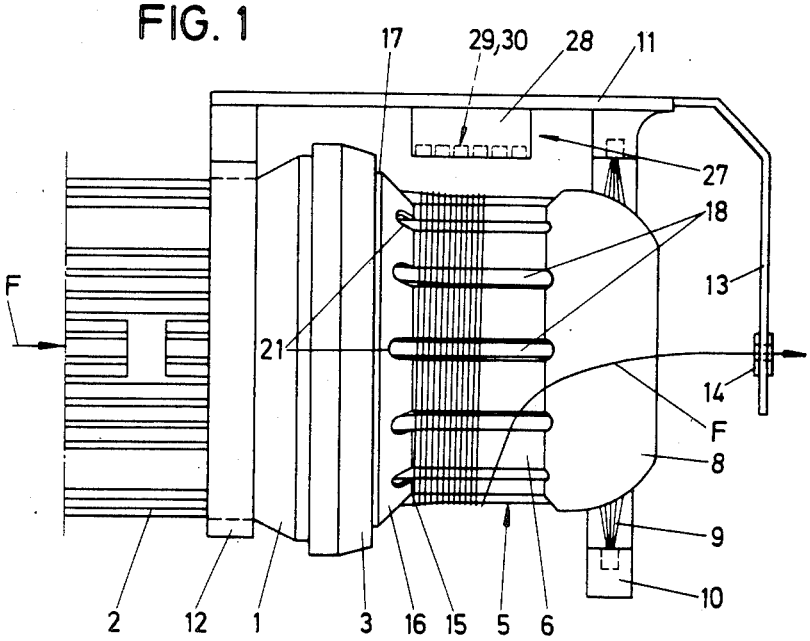
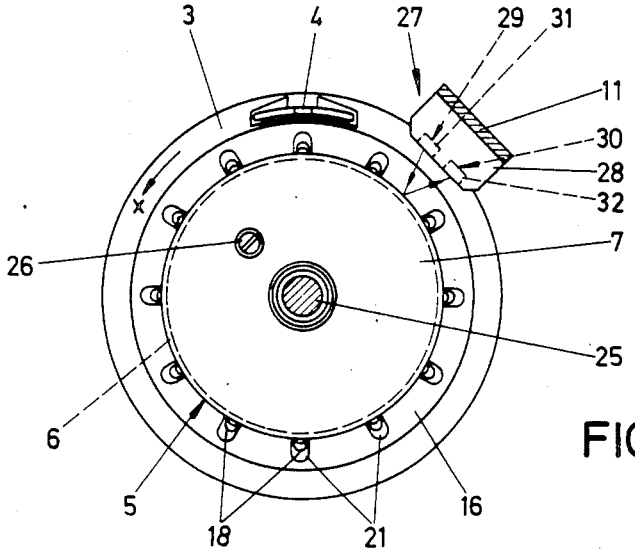
FIG. 2

DELIVERY DEVICE FOR CONTINUOUS THREADS

FIELD AND BACKGROUND OF THE INVENTION

The present invention relates to a delivery device for continuous threads having a storage member to which the thread is fed in circumferential direction and from which it is withdrawn over its head and on which a given adjustable number of thread turns is stored as a feed point and a withdrawal point, a light monitor which scans the circumferential surface of the storage member and controls the rotary drive for the feeding of the thread being provided in order to determine the number of thread turns.

Such a device is known from Federal Republic of Germany Pat. No. 1 760 738, the light monitor serving to control the drive of the storage member in such a manner that an approximately predetermined supply of turns is present on the storage member. If the withdrawal of the thread which takes place in axial direction reaches such an order of magnitude that the supply of turns is less than a certain lower limit then the light monitor causes an increase in the speed of rotation of the storage member. Conversely, a decelerating of the speed of rotation or even a stopping of the storage member takes place when the supply of turns exceeds the given maximum limit. The delivery device, therefore, operates essentially by the start/stop principle. As a result, the thread to be stored is subjected to unfavorable tensile stresses. Furthermore, the braking device of such delivery devices is subjected to considerable stress.

The object of the present invention is so to develop a delivery device of the introductory-mentioned type in question in a manner which is simple to manufacture and in addition to making the thread tension uniform upon the application of the thread onto the storage member the brake device is subjected to less stress.

SUMMARY OF THE INVENTION

According to the invention the speed of rotation of the rotary drive is controlled as a function of the intensity of light measured at the receiver.

As a result of this development a delivery device of this type is obtained which is of increased value in use. In contradistinction to the prior art, the light monitor extends over the entire storage length of the storage member. The larger the number of turns of thread applied to the storage member the smaller the reflected light intensity. This means that with an increase in the reduction of the intensity of the light, the speed of rotation of the storage member is also reduced. In this way, a constant storage quantity can be obtained on the storage member without having to operate in accordance with the start/stop principle. The tension of the thread applied is made uniform. The measurement of the light intensity (quantity of light) can be effected with a light monitor strip—integrated over it—or else over the time interval which elapses in each case between the darkening and response of a light monitor which scans only the withdrawal-side thread turns. The rotary drive stops the storage member only if the thread turns extend over its entire storage length. This, to be sure, is a special case which hardly occurs in actual practice. Therefore the brake device which is associated with the delivery device is subjected only to slight stress, and in addition there is a larger life expectancy for the delivery device.

In order to change the number of turns of thread on the storage member and the speed of winding for the filling thereof, the intensity of the light of the light-monitor transmitter is variable over the storage length. This can be achieved, for instance, by a potentiometer. In this way, a change in the quantity of supply can be obtained in a simple manner. Thus, for instance, by increasing the light intensity the number of thread turns and the winding speed can be increased. A reduction of the light intensity, on the other hand, means a decrease in the number of thread turns stored and a decrease in the winding speed. Other variations can be obtained by forming the light-monitor transmitter of light-emitting diodes of adjustable light intensity which are arranged in a row alongside of each other and emit modeled light. It is therefore possible to increase the light intensity uniformly at all the transmitters. However, an individual increase of the light intensity can also be effected. It is advantageous if the light-monitor strip is formed in such a manner that a light guide is provided which transmits the light from one point on the circumference of the storage member to another point. This light guide may consist of a block of glass or the like or of light-guide fibers which are held by a support. In order to make the control of the light monitor less susceptible to disturbance it is therefore advantageous for the storage member to have a support piece with light-guide fibers, the end surfaces of which lie in a row alongside of each other are exposed towards the circumferential surface of the storage member, one end surface of each light-guide fiber facing the light-monitor transmitter and the other end surface, staggered in the circumferential direction of the storage member, facing the receiver. Modulated light is preferably employed in order to exclude disturbing effects from daylight or the like. For this purpose, it is advantageous to develop the support piece with the shape of an arc. The transmitter and receiver of the light monitor can therefore be arranged alongside of each other. Another feature is that the end surfaces of the light-guide fibers lie in two adjacent bars, displaceably associated with the storage member, for variation of the circumferential surface of the storage member in the region of the thread run-on point. This feature is for a stationary storage member. If the bars are displaced, the light-guide fibers are moved with them. They, however, still serve as a support for the supply of turns to be applied and lead to better measurement results. On the other hand, if the storage member rotates, then a plurality of arcuate pieces are to be provided lying one after the other in the circumferential direction of the storage member in such a manner that their distance apart is smaller than the aperture cone devolving upon the light monitor transmitter and receiver. Accordingly, the connection of transmitter and receiver via an arcuate piece is retained in every position of rotation of the storage member. Advantages from a manufacturing standpoint are obtained if the support piece consists of two plates which lie concentrically to each other and receive the light-guide fibers between themselves.

BRIEF DESCRIPTION OF THE DRAWINGS

Three embodiments of the invention will be described below with reference to FIGS. 1 to 8 of the drawing, in which:

FIG. 1 is a view of a suitably developed delivery device equipped with a light monitor, in accordance with the first embodiment;

FIG. 2 is an end view of the delivery device, the barrel-shaped annular head surface of the storage member being omitted;

DETAILED DESCRIPTION OF THE PREFERRED EMBODIMENTS

Figure 3:
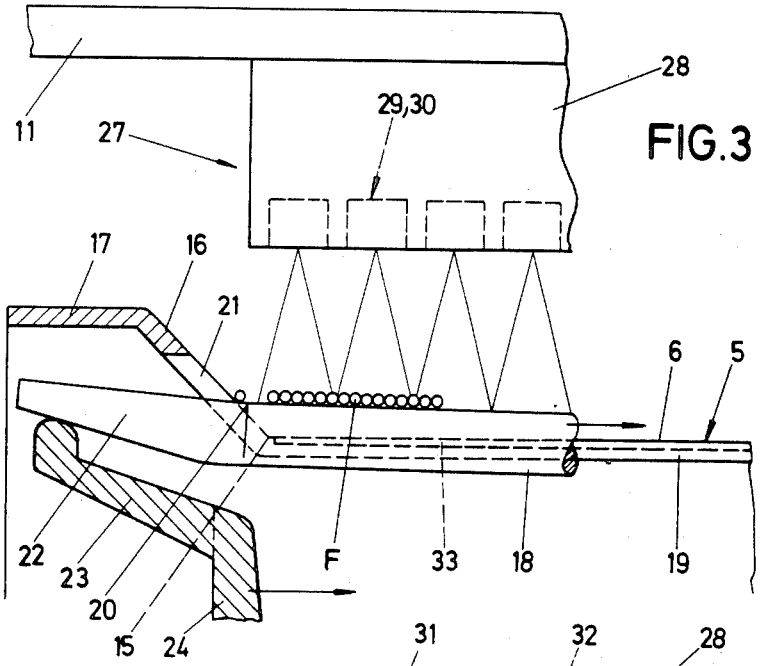
FIG. 3 shows, on a larger scale, a longitudinal section through the storage member in the region of the thread run-on point and of the light monitor.
Figure 4:
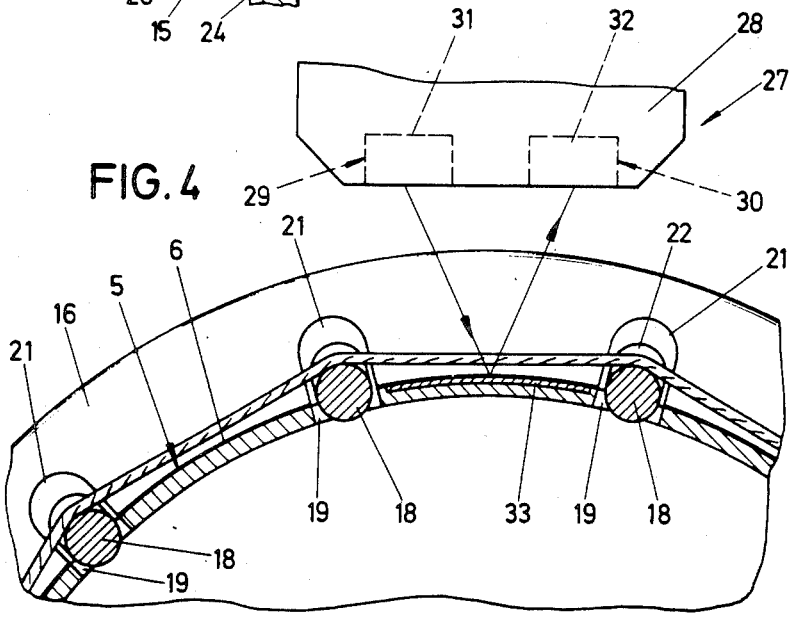
FIG. 4 is a cross section through the storage member shown in FIG. 3.

The delivery device of the first embodiment shown in FIGS. 1 to 4 has an electric motor 2 or the like which constitutes the rotary drive and is flanged onto a housing 1. Its drive shaft (not shown in detail) is connected fixed for rotation to a thread eyelet holder 3. The entering thread F fed passes into a center channel in the motor drive shaft and from there to the thread eyelet 4 of the thread eyelet holder 3, which revolves in the direction indicated by the arrow x in FIG. 2. A braking device, not shown in detail, such as known for such delivery devices is associated with the rotary drive.

The motor shaft of the electric drive 2 bears a storage member 5. Here the storage member is stationary. In detail it has a circumferential wall 6 developed as drum which passes at a removal end of the delivery device into an end wall 7. The removal end of the circumferential wall 6 is gripped over by a barrel-shaped annular head surface 8 (not shown in FIG. 2). With the latter there is associated a brake ring 10 provided with bristles 9 which in its turn is seated on an extension 11. The latter is fastened by an annular flange 12 to the housing 1.

The end of the extension 11 which faces the annular head surface 8 bears on a downwardly-bent portion 13 a thread withdrawal eyelet 14 which is coaxial to the axis of the storage member 5 and is arranged spaced in front of the annular head surface 8.

The end of the circumferential wall 6 which faces the thread eyelet support 3 passes via an angular channel 15 into a conical widening 16. The angle of inclination of this conical widening is about 45°. Adjoining the conical widening 16 there is a parallel extending section 17 which is gripped over by the thread eyelet holder 3.

Bars 18 are associated, arranged at equal angles apart, with the storage member 5, the bars lying in part in grooves 19 in the circumferential wall 6 and protruding beyond said wall. The bars 18 which extend approximately over the entire axial length of the storage member 5 form their own angular channels 20 at the ends thereof facing the angular channel 15. Their channel angle is somewhat less than 180°. The ends 22 of the bars 18 which adjoin the angular channel 20 engage into slots 21 in the conical widening 16 which extend from the grooves 19. The ends 22 of the bars rest on radially directed fingers 23 of a displacement disk 24.

By means of a central handle 25 which is accessible from the ring head surface 8 the bars 18 with disk 24 and fingers 23 can be shifted simultaneously in the direction of the arrow shown in FIG. 3. However, it is also possible to move the displacement disk 24 alone by an adjustment screw 26. The latter is also accessible from the ring head surface 8. Displacement of the disk 24 in the direction of the arrow leads to a swinging of the bars 18 around a pivot point which is located close to the ring head surface. In both cases the winding conditions in the region of the thread feed point are changed.

On the extension 11 there is furthermore a light monitor strip 27 which extends over the entire storage length of the storage member 5. In the embodiment shown by way of example the storage length is smaller than the length of the storage member 5 itself. The light monitor strip can also extend over merely a shorter length.

The light monitor 27 has a housing 28. This housing supports a transmitter 29 and receiver 30 of the light monitor. Both transmitter 29 and receiver 30 extend axially parallel to the storage member 5. The light-monitor transmitter 29 has light-emitting diodes 31 of adjustable luminous intensity which emit modulated light and are arranged in a row alongside of each other. Each light-emitting diode 31 has preferably associated with it its own sensor 32 of the light-monitor receiver 30.

A reflector plate 33 is embedded in the circumferential wall 6 in the region of the circumferential wall between two bars 18. The light coming from the transmitter 29 therefore arrives at this reflector plate 33 and is then reflected to the receiver 30 of the light monitor.

When the thread F is brought onto the storage member 5 and the delivery device turned on the light intensity measured by the light monitor receiver 30 is initially relatively high, so that the rotary drive operates with increased speed of rotation. With an increasing amount of thread stored, the intensity of the light measured by the light monitor receiver 30 decreases along with a reduction in the speed of rotation of the rotary drive. As a result of the continuous removal of thread, however, the intensity of the light again increases, with renewed increase in the speed of rotation of the thread eyelet holder 3. Therefore, the rotary drive does not need to be completely stopped. Peak stresses which could lead to the breaking of the thread are thereby avoided.

If the light intensity of the light monitor transmitter 29 is increased, the light response threshold shifts along therewith. In this way an increase in the speed of rotation takes place together with an increase in the amount of thread stored on the storage member.

Figure 5:
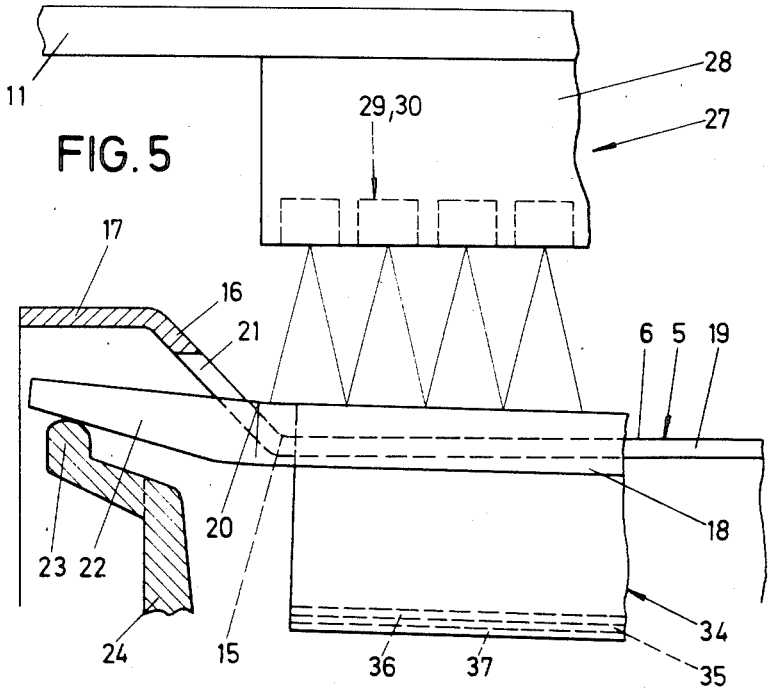
FIG. 5 is a longitudinal section corresponding to FIG. 3 through the storage member, but with the use of the support piece relating to the second embodiment.
Figure 6:
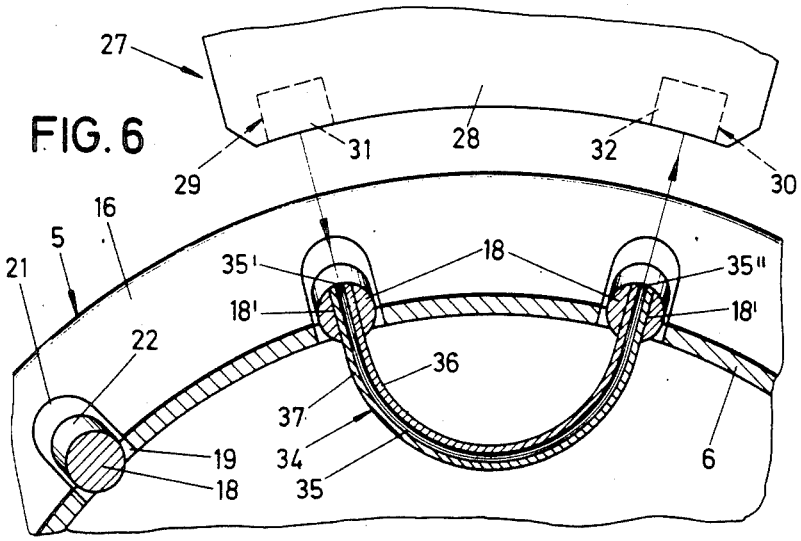
FIG. 6 is a cross section through the storage member in the region of the support piece.

In the second embodiment, shown in FIGS. 5 and 6, the same structural parts bear the same reference numbers. Instead of the reflector plate 33 the storage member 5 now has a support piece 34. The latter is shaped as an arc and consists of two plates 36 and 37 which are concentric to each other and receive light-guide fibers 35 between each other. As material for the plates 36, 37 aluminum, for instance, can be employed. The light-guide fibers 35 are so arranged that their end surfaces 35′, 35″ which lie in a row alongside of each other are exposed towards the circumferential surface of the storage member. In each case, one end surface 35′ of each light-guide fiber 35 faces the light monitor transmitter 29 and the other end surface 35″, angularly offset in the circumferential direction of the storage member 5, faces the light monitor receiver 30. The end sections of the arcuate piece are inserted in slits 18' in two adjacent bars 18 in such a manner that the end surfaces 35', 35'' are flush with the circumferential surface of the bars 18. Upon a displacement of the bars, the end surfaces 35', 35'' of the light-guide fibers 35 are accordingly also shifted.

Figure 7:
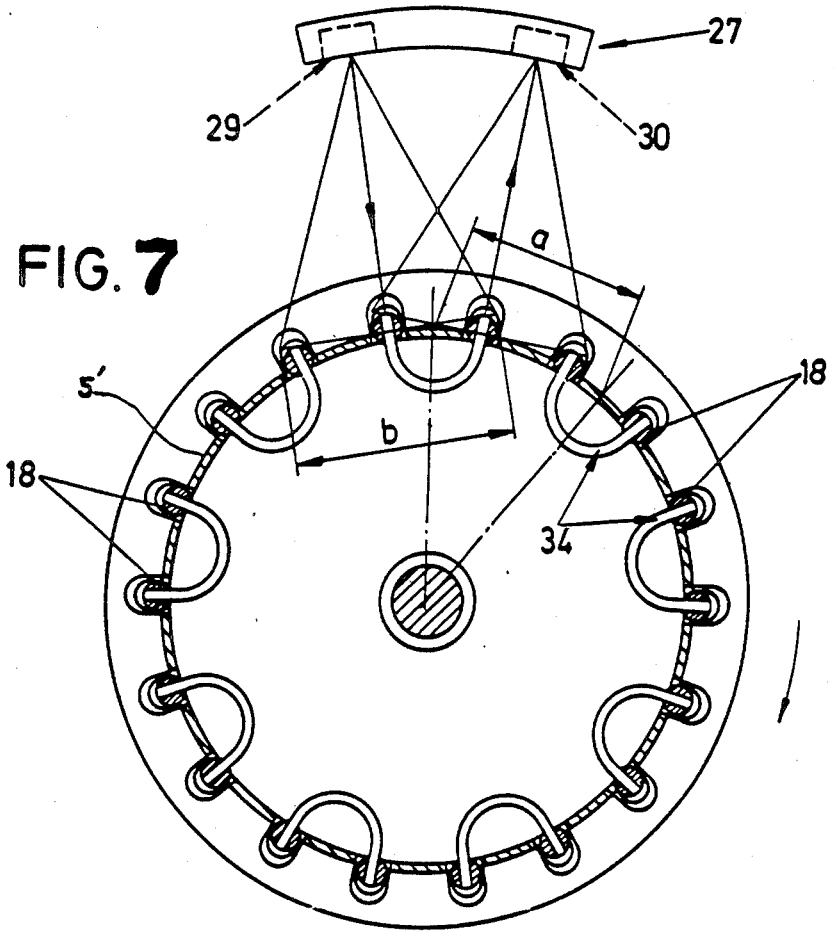
FIG. 7 is a cross-section through a rotatable storage member of the third embodiment of the invention.
Figure 8:
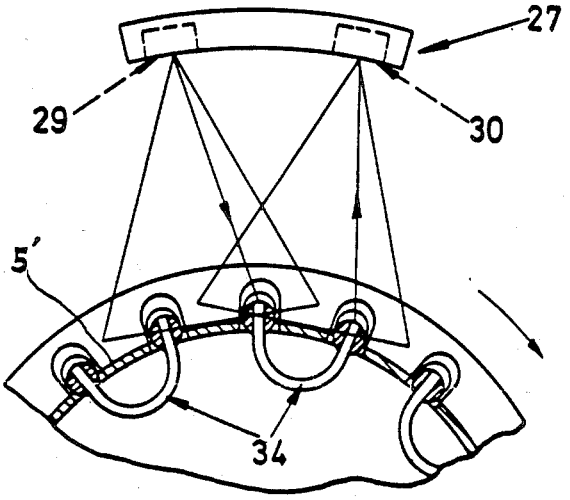
FIG. 8 is a portion of FIG. 7 in a slightly different rotated position.

Referring to FIGS. 7 and 8, when a rotating storage member 5 is used, a plurality of such arcuate pieces 24 are arranged one after the other in the circumferential direction of the storage member. Their distance apart a must then be kept smaller than the aperture cone 6 devolving on the light monitor transmitter 29 and receiver 30. Thus the light monitor 27 is in position ready for operation in every position of rotation of the storage member.

I claim:

1. A delivery device for continuous threads, comprising a storage member, means including a rotary drive for feeding thread to said storage member in circumferential direction, the thread being stored on said member with a predetermined adjustable number of thread turns as a storage quantity between a feed point and a withdrawal point, the thread being withdrawn from the storage member therefrom, means comprising a light monitor including a receiver, for scanning a circumferential surface of the storage member and controlling said rotary drive for feeding the thread for determining the number of thread turns such that the speed of rotation of the rotary drive is continuously controlled as a function of intensity of light measured at the receiver, the light monitor is formed as a light-monitor strip which extends approximately over a thread storage length of the storage member, and wherein said light monitor includes a light transmitter, said light transmitter includes means for initiating a light intensity of the transmitter which is variable over the storage length of the storage member.

2. The delivery device according to claim 1, wherein said means of the light transmitter comprises light-emitting diodes of adjustable light intensity, said diodes are arranged in a row alongside of each other and emit modeled light.

3. The delivery device according to claim 1, wherein the storage member has a light guide, said light guide has end surfaces which are freely exposed adjacent the circumferential surface of the storage member, one end surface of said light guide faces the transmitter, and the other end surface of said light guide is offset in circumferential direction of the storage member relative said one end surface and faces the receiver.

4. The delivery device according claim 3, wherein said light guide comprises a plurality of individual light-guide fibers disposed in a row alongside of each other and a support piece holding said fibers, said fibers have end surfaces constituting said end surfaces of said light guide.

5. The delivery device according to claim 4, wherein the support piece is an arcuate piece.

6. The delivery device according to claim 4, further comprising bars displaceably coordinated to the storage member for varying the circumferential surface of the storage member in a region of a thread wind-on point, and the end surfaces of the light-guide fibers lie are disposed in two adjacent of said bars.

7. The delivery device according to claim 1, wherein a plurality of arcuate pieces forming light guides having ends facing said transmitter and said receiver, respectively, said light guides are disposed one after the other, in the circumferential direction of the storage member in such a manner that their distance apart from each other is less than an aperture cone of light devolving upon the transmitter and receiver.

8. The delivery device according to claim 4, wherein the support piece comprises two plates which are concentric to each other and said light-guide fibers are disposed between said two plates.

* * * * *